US008922595B2

(12) United States Patent
Ahn et al.

(10) Patent No.: US 8,922,595 B2
(45) Date of Patent: Dec. 30, 2014

(54) DEGRADATION COMPENSATION UNIT, LIGHT-EMITTING APPARATUS INCLUDING THE SAME, AND METHOD OF COMPENSATING FOR DEGRADATION OF LIGHT-EMITTING APPARATUS

(75) Inventors: Jeong-Keun Ahn, Yongin (KR); Do-Ik Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 285 days.

(21) Appl. No.: 13/237,436

(22) Filed: Sep. 20, 2011

(65) Prior Publication Data

US 2012/0212516 A1 Aug. 23, 2012

(30) Foreign Application Priority Data

Feb. 17, 2011 (KR) ..... 10-2011-0014185

(51) Int. Cl.
*G09G 5/10* (2006.01)
*G09G 3/32* (2006.01)

(52) U.S. Cl.
CPC ..... *G09G 3/3233* (2013.01); *G09G 2320/0285* (2013.01); *G09G 2320/043* (2013.01)
USPC ..... 345/690

(58) Field of Classification Search
None
See application file for complete search history.

(56) References Cited

U.S. PATENT DOCUMENTS

| | | | | |
|---|---|---|---|---|
| 6,166,490 | A * | 12/2000 | Hansen | 315/169.1 |
| 6,525,683 | B1 * | 2/2003 | Gu | 341/140 |
| 6,897,842 | B2 * | 5/2005 | Gu | 345/90 |
| 2003/0052904 | A1 * | 3/2003 | Gu | 345/691 |
| 2003/0174152 | A1 * | 9/2003 | Noguchi | 345/690 |

FOREIGN PATENT DOCUMENTS

| | | | |
|---|---|---|---|
| KR | 10-2003-0027788 | A | 4/2003 |
| KR | 10-2003-0027846 | A | 4/2003 |
| KR | 10-2009-0054324 | A | 5/2009 |

* cited by examiner

*Primary Examiner* — David D Davis
(74) *Attorney, Agent, or Firm* — Christie, Parker & Hale, LLP

(57) ABSTRACT

A degradation compensation unit including a first operation unit receiving downscaled gray data of each pixel for one frame at set or predetermined intervals and calculating a degradation time of each pixel corresponding to the downscaled gray data; an accumulation operation unit receiving the degradation time of each pixel from the first operation unit and calculating an accumulated degradation time of each pixel by accumulating the degradation time of each pixel; a weight calculation unit receiving the accumulated degradation time of each pixel from the accumulation operation unit and calculating a degradation compensation weight for each pixel based on the accumulated degradation time of each pixel; and a second operation unit producing compensated gray data for each pixel corresponding to the degradation compensation weight for each pixel, which is received from the weight calculation unit, and providing the compensated gray data for each pixel to a data driver.

14 Claims, 4 Drawing Sheets

DEGRADATION COMPENSATION UNIT, LIGHT-EMITTING APPARATUS INCLUDING THE SAME, AND METHOD OF COMPENSATING FOR DEGRADATION OF LIGHT-EMITTING APPARATUS

CROSS-REFERENCE TO RELATED APPLICATION

This application claims priority to and the benefit of Korean Patent Application No. 10-2011-0014185, filed on Feb. 17, 2011, in the Korean Intellectual Property Office, the entire content of which is incorporated herein by reference.

BACKGROUND

1. Field

The following description relates to a light-emitting apparatus including a degradation compensation unit.

2. Description of the Related Art

Active matrix organic light-emitting diode (AMOLED) panels are panels that generate light by providing (flowing) current to an organic light-emitting diode (OLED) which is a self-luminous element. When an OLED continuously emits light for a certain period of time, even if the same current is provided (flowed) to the OLED, the amount of light that the OLED emits tends to decrease over time.

This is because the OLED is degraded over time. A reduction in the amount of light that the OLED emits may lead to the deterioration of image quality of the entire panel. Therefore, there is a need to reduce the degradation of the OLED.

SUMMARY

An aspect of an embodiment the present invention is directed toward a degradation compensation unit which can compensate for the degradation of each organic light-emitting element (pixel) included in a display panel.

An aspect of an embodiment of the present invention is directed toward a light-emitting apparatus in which the degradation of each organic light-emitting element included in a display panel is compensated for to improve the display quality of the light-emitting apparatus.

An aspect of an embodiment of the present invention is directed toward a method of compensating for the degradation of a light-emitting apparatus to improve the display reliability of the light-emitting apparatus.

However, aspects of the present invention are not restricted to the one set forth herein. The above and other aspects of the present invention will become more apparent to one of ordinary skill in the art to which the present invention pertains by referencing the detailed description of embodiments of the present invention given below.

According to an embodiment of the present invention, there is provided a degradation compensation unit including: a first operation unit for receiving downscaled gray data of each pixel for one frame at set or predetermined intervals and for calculating a degradation time of each pixel corresponding to the downscaled gray data; an accumulation operation unit for receiving the degradation time of each pixel from the first operation unit and for calculating an accumulated degradation time of each pixel by accumulating the degradation time of each pixel; a weight calculation unit for receiving the accumulated degradation time of each pixel from the accumulation operation unit, and for calculating a degradation compensation weight for each pixel based on the accumulated degradation time of each pixel; and a second operation unit for receiving the degradation compensation weight for each pixel, for producing compensated gray data for each pixel corresponding to the degradation compensation weight for each pixel, and for providing the compensated gray data for each pixel to a data driver.

According to another embodiment of the present invention, there is provided a light-emitting apparatus including: a display panel comprising a plurality of pixels defined by a plurality of gate lines and a plurality of data lines, each pixel comprising at least one light-emitting element; a gate driver for transmitting gate signals to the gate lines; and a data driver for receiving compensated gray data respectively for the pixels from a degradation compensation unit and transmitting the compensated gray data to the data lines. Here, the degradation compensation unit includes: a first operation unit for receiving downscaled gray data of each pixel for one frame, at set or predetermined intervals, and for calculating a degradation time of each pixel corresponding to the downscaled gray data; an accumulation operation unit for receiving the degradation time of each pixel from the first operation unit, and for calculating an accumulated degradation time of each pixel by accumulating the degradation time of each pixel; a weight calculation unit for receiving the accumulated degradation time of each pixel from the accumulation operation unit and for calculating a degradation compensation weight for each pixel based on the accumulated degradation time of each pixel; and a second operation unit for receiving the degradation compensation weight for each pixel, for producing the compensated gray data for each pixel corresponding to the degradation compensation weight for each pixel, and for providing the compensated gray data for each pixel to the data driver.

According to still another embodiment of the present invention, there is provided a method of compensating for the degradation of a light-emitting apparatus, the method including: receiving downscaled gray data of each pixel for one frame at set or predetermined intervals and calculating a degradation time of each pixel corresponding to the downscaled gray data; calculating an accumulated degradation time of each pixel by adding the calculated degradation time of each pixel to degradation times of each pixel up to a previous time; calculating a degradation compensation weight corresponding to the accumulated degradation time of each pixel utilizing a luminance value curve of a light-emitting element of each pixel over time; and producing compensated gray data for each pixel by multiplying the degradation compensation weight for each pixel by the downscaled gray data for each pixel and providing the compensated gray data for each pixel to a data driver.

BRIEF DESCRIPTION OF THE DRAWINGS

The above and other aspects and features of the present invention will become more apparent by describing in detail exemplary embodiments thereof with reference to the attached drawings, in which.

DETAILED DESCRIPTION

Figure 1:
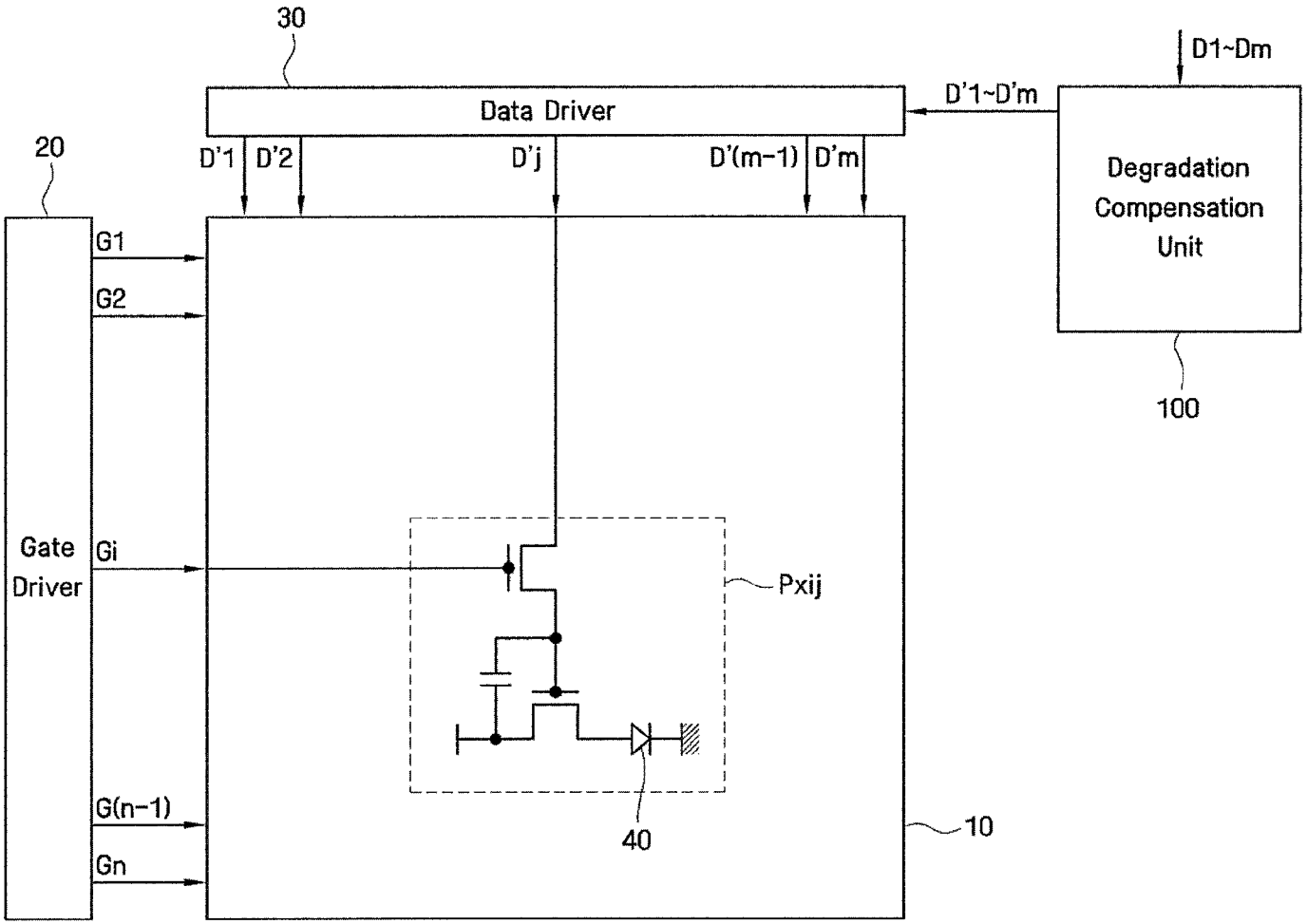
FIG. 1 is a block diagram of a light-emitting apparatus according to an exemplary embodiment of the present invention.

Advantages and features of the present invention and methods of accomplishing the same may be understood more readily by reference to the following detailed description of embodiments and the accompanying drawings. The present invention may, however, be embodied in many different forms and should not be construed as being limited to the embodiments set forth herein. Rather, these embodiments are provided so that this disclosure will be thorough and complete and will fully convey the concept of the invention to those skilled in the art, and the present invention will only be defined by the appended claims. In the drawings, the thickness of layers and regions are exaggerated for clarity.

The terminology used herein is for the purpose of describing particular embodiments only and is not intended to be limiting of the invention. As used herein, the singular forms "a", "an", and "the" are intended to include the plural forms as well, unless the context clearly indicates otherwise. It will be further understood that the terms "comprises" and/or "made of," when used in this specification, specify the presence of stated features, integers, steps, operations, elements, and/or components, but do not preclude the presence or addition of one or more other features, integers, steps, operations, elements, components, and/or groups thereof.

It will be understood that, although the terms first, second, etc. may be used herein to describe various elements, these elements should not be limited by these terms. These terms are only used to distinguish one element from another element. Thus, for example, a first element, a first component, or a first section discussed below could be termed a second element, a second component, or a second section without departing from the teachings of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Hereinafter, a light-emitting apparatus and a degradation compensation unit included in the light-emitting apparatus according to an exemplary embodiment of the present invention will be described with reference to FIGS. 1 through 3.

FIG. 1 is a block diagram of a light-emitting apparatus according to an exemplary embodiment of the present invention. FIG. 2 is a block diagram of a degradation compensation unit 100 shown in FIG. 1. FIG. 3 is a graph illustrating an example luminance value curve stored in a lookup table (LUT) 162 of the degradation compensation unit 100 shown in FIG. 2.

Referring to FIG. 1, the light-emitting apparatus according to the current exemplary embodiment may include a display panel (display region) 10, a gate driver 20, a data driver 30, and the degradation compensation unit 100.

The display panel 10 may include a plurality of pixels PXij defined by a plurality of gate lines and a plurality of data lines. Here, each of the pixels PXij may include at least one light-emitting element 40. The light-emitting element 40 may be, but is not limited to, an organic light-emitting diode (OLED). While an exemplary circuit of each pixel PXij is illustrated in FIG. 1, the present invention is not limited to the circuit of FIG. 1.

The gate driver 20 may transmit gate signals G1 through Gn respectively to the gate lines, thereby turning each of the pixels PXij on or off. The data driver 30 may transmit data signals D'1 through D'm respectively to the data lines, thereby enabling each of the pixels PXij to display an image. The data signals D'1 through D'm transmitted to the data lines by the data driver 30 of the light-emitting apparatus, according to the current exemplary embodiment, may be gray data (gray level data) D'1 through D'm that the degradation compensation unit 100 produces after compensating for gray data (gray level data) D1 through Dm received from an external source. Specifically, as will be described in detail later, the degradation compensation unit 100 receives the gray data D1 through Dm (respectively for the pixels PXij) from the external source and compensates for the gray data D1 through Dm according to the degree of degradation of the light-emitting element 40 of each of the pixels PXij that constitute the display panel 10. When the compensated gray data D1 through Dm (hereinafter, the compensated gray data will be indicated by reference characters D'1 through D'm) respectively for the pixels PXij are provided to the data driver 30, the data driver 30 may send the compensated gray data D'1 through D'm to the data lines.

The data driver 30 of the light-emitting apparatus, according to the current exemplary embodiment, may drive the light-emitting element 40 of each pixel PXij using a constant-voltage driving method. This may refer to a situation when the luminance of the light-emitting element 40 is controlled according to the pulse width of gray data.

The degradation compensation unit 100 may compensate for the gray data D1 through Dm (respectively for the pixels PXij) received from the external source according to the degree of degradation of the light-emitting element 40 of each of the pixels PXij that constitute the display panel 10 and may provide the compensated gray data D'1 through D'm (respectively for the pixels PXij) to the data driver 30.

The degradation compensation unit 100 according to the current exemplary embodiment will now be described in greater detail with reference to FIGS. 2 and 3.

Figure 2:
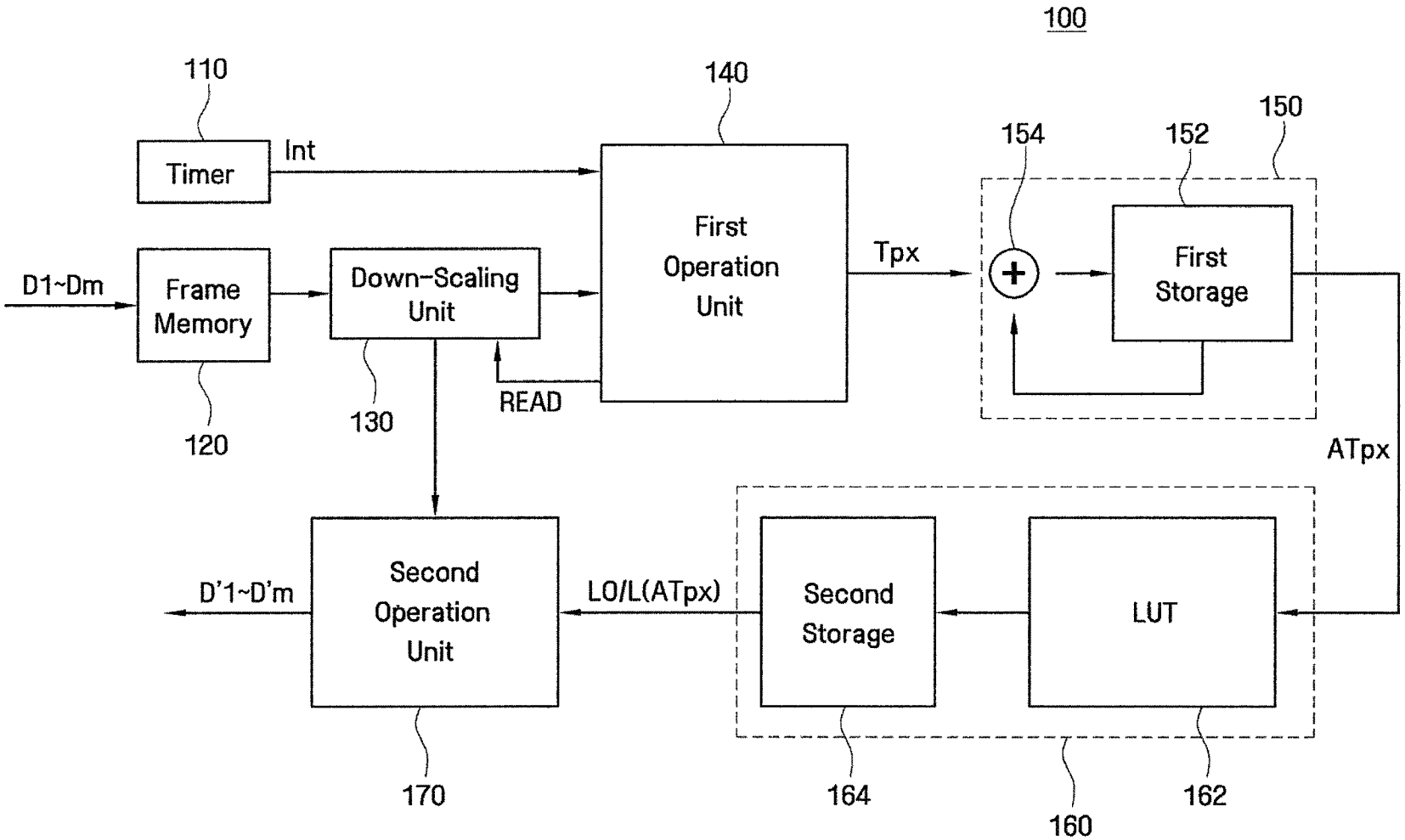
FIG. 2 is a block diagram of a degradation compensation unit shown in FIG. 1.

Referring to FIG. 2, the degradation compensation unit 100 may include a timer 110, a frame memory 120, a downscaling unit 130, a first operation unit 140, an accumulation operation unit 150, a weight calculation unit 160, and a second operation unit 170.

The first operation unit 140 receives downscaled gray data that constitute one frame and are respectively for a plurality of pixels, at set or predetermined intervals, and calculates the degradation time of each pixel based on the received downscaled data. This operation may be implemented using, for example, the timer 110, the frame memory 120, and the downscaling unit 130 as shown in FIG. 2.

First, the gray data D1 through Dm (that constitute one frame and are respectively for the pixels PXij) are received from the external source and are stored in the frame memory 120. Then, the gray data D1 through Dm are provided to the downscaling unit 130.

The downscaling unit 130 receives the gray data D1 through Dm, which constitute one frame and are respectively for the pixels PXij, and downscales the received gray data D1 through Dm. That is, when the gray data D1 through Dm received from the external source have a first range (a first gray scale), the downscaling unit 130 downscales the gray data D1 through Dm to have a second range (a second gray scale) which is narrower than the first range. Specifically, when the gray data D1 through Dm received from the external source have a range of 0 to 1023, the downscaling unit 130 may downscale the gray data D1 through Dm to have a range of 0 to 712. Here, the first range of the gray data D1 through Dm received from the external source and the second range of the downscaled gray data D1 through Dm can be changed as desired. The downscaled gray data D1 through Dm (respectively for the pixels PXij) are provided to the second operation unit 170 unless a read signal READ is transmitted from the first operation unit 140 to the downscaling unit 130.

The timer 110 generates an interrupt signal Int at set or predetermined intervals. For example, when the set or predetermined intervals are one minute, the timer 110 generates the interrupt signal Int every one minute and provides the generated interrupt signal Int to the first operation unit 140. The first operation unit 140 which receives the interrupt signal Int transmits the read signal READ to the downscaling unit 130. When receiving the read signal READ from the first operation unit 140, the downscaling unit 130 provides the downscaled gray data D1 through Dm (respectively for the pixels PXij) to the first operation unit 140. Accordingly, the first operation unit 140 may be provided with the downscaled gray data D1 through Dm for one frame at the set or predetermined intervals.

In FIG. 2, the first operation unit 140 transmits the read signal READ to the downscaling unit 130 when receiving the interrupt signal Int. However, the present invention is not limited thereto. In a modified embodiment, the first operation unit 140 may transmit the read signal READ to the frame memory 120 when receiving the interrupt signal Int. In response to the read signal READ, the frame memory 120 may send the gray data D1 through Dm having the first range to the downscaling unit 130. Then, the downscaling unit 130 may downscale the gray data D1 through Dm having the first range to have the second range and provide the downscaled gray data D1 through Dm to the first operation unit 140. That is, the present invention is not limited to the configuration of FIG. 2, and the configuration of FIG. 2 can be changed as desired. A degradation compensation unit 100 according to another exemplary embodiment of the present invention is described in more detail later.

As described above, the timer 110 generates the interrupt signal Int at set or predetermined intervals. Here, the set or predetermined intervals may gradually increase. Specifically, the intervals at which the timer 110 generates the interrupt signal Int may double each time. For example, when the timer 110 generates the interrupt signal Int one minute later, it may generate the interrupt signal Int two minutes later next time and then four minutes later the time after next. However, the intervals may not necessarily double and can be increased by various amounts.

The first operation unit 140 may receive the downscaled gray data D1 through Dm that constitute one frame and are respectively for the pixels PXij, and may then calculate a degradation time Tpx of each pixel PXij based on the downscaled gray data D1 through Dm. Specifically, the first operation unit 140 may calculate the degradation time Tpx of each pixel PXij using the intervals, the downscaled gray data for each pixel PXij, and reference gray data. More specifically, the first operation unit 140 may calculate the degradation time Tpx of each pixel PXij by dividing the downscaled gray data for each pixel PXij by the reference gray data and multiplying the division result by the intervals. That is, the degradation time Tpx of each pixel PXij may be given by Equation 1 below.

Degradation time *Tpx* of each pixel=(downscaled gray data for each pixel/reference gray data)×intervals (Equation 1).

Here, the reference gray data may be a gray data value representing an initial luminance value L0 on a luminance value curve (see FIG. 3) of the light-emitting element 40 (see FIG. 1) of each pixel PXij (see FIG. 1) over time. The luminance value curve of the light-emitting element 40 over time may be stored in the LUT 162 which will be described later in more detail. For example, when the downscaled gray data D1 through Dm (respectively for the pixels PXij) have a range of 0 to 720 and when a gray data value of 720 represents the initial luminance value L0 on the luminance value curve, the reference gray data may be 720. This will be described in more detail later when the operation of the light-emitting apparatus according to the current exemplary, embodiment is described.

Referring back to FIG. 2, the accumulation operation unit 150 may receive the degradation time Tpx of each pixel PXij from the first operation unit 140 and calculate an accumulated degradation time ATpx of each pixel PXij by accumulating the received degradation time Tpx of each pixel PXij. The accumulation operation unit 150 may include a first storage 152 and an adder 154.

The first storage 152 may store the accumulated degradation time ATpx of each pixel PXij up to a previous time (e.g., time just before the current time). The first storage 152 may be implemented as a nonvolatile memory such as a flash memory. The adder 154 may add the degradation time Tpx of each pixel PXij received from the first operation unit 140 to the accumulated degradation time ATpx (stored in the first storage 152) of each pixel PXij up to the previous time. Then, the addition result is stored in the first storage 152. In this case, the accumulated degradation time ATpx of each pixel PXij up to a current time is stored in the first storage 152.

Although the accumulation operation unit 150 shown in FIG. 2 includes the first storage 152 and the adder 154, the present invention is not limited thereto. The configuration of the accumulation operation unit 150 can be changed as desired as long as the accumulation operation unit 150 can receive the degradation time Tpx of each pixel PXij from the first operation unit 140 and calculate the accumulated degradation time ATpx of each pixel PXij by accumulating the received degradation time Tpx of each pixel PXij.

The weight calculation unit 160 may receive the accumulated degradation time ATpx of each pixel PXij from the accumulation operation unit 150 and calculate a degradation compensation weight L0/L(ATpx) for each pixel PXij based on the accumulated degradation time ATpx of each pixel PXij. The weight calculation unit 160 may include the LUT 162 and a second storage 164.

Figure 3:
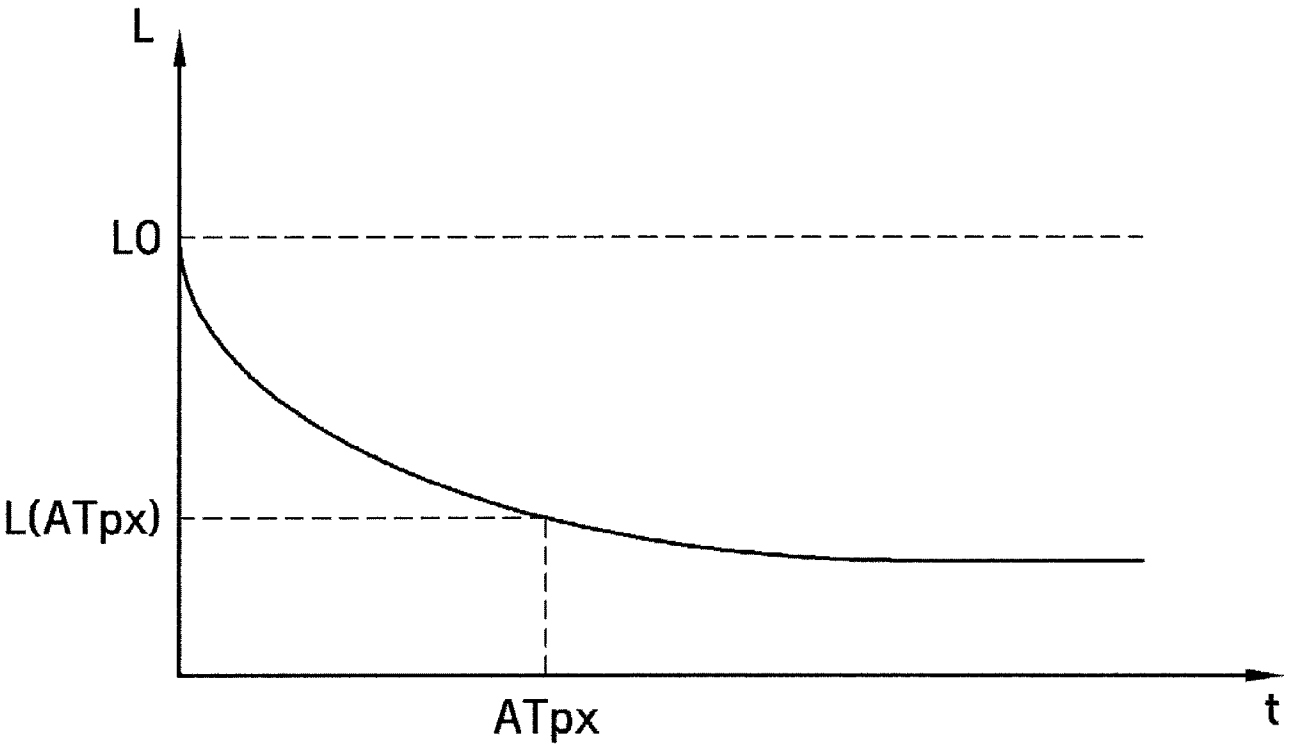
FIG. 3 is a graph illustrating an example luminance value curve stored in a lookup table (LUT) of the degradation compensation unit shown in FIG. 2.

As shown in FIG. 3, the luminance value curve of the light-emitting element 40 of each pixel PXij over time may be stored in the LUT 162. The LUT 162 may receive the accumulated degradation time ATpx of each pixel PXij from the accumulation operation unit 150 and output the degradation compensation weight L0/L(ATpx) corresponding to the accumulated degradation time ATpx of each pixel PXij. The degradation compensation weight L0/L(ATpx) for each pixel PXij may be calculated by dividing the initial luminance value L0 stored in the LUT 162 by a luminance value L(Tpx) corresponding to the accumulated degradation time ATpx of each pixel PXij on the luminance value curve (see FIG. 3) over time. That is, the degradation compensation weight L0/L(ATpx) for each pixel PXij may be given by Equation 2 below.

Degradation compensation weight $L0/L(ATpx)$ for each pixel=initial luminance value $L0$/luminance value $L(ATpx)$ corresponding to the accumulated degradation time $ATpx$ of each pixel (Equation 2).

The calculated degradation compensation weight L0/L (ATpx) for each pixel PXij may be stored in the second storage 164 and then provided to the second operation unit 170. The second storage 164 may be implemented as a memory such as a static random-access memory (SRAM). Although the weight calculation unit 160 shown in FIG. 2 includes the second storage 164, the second storage 164 can be omitted when necessary.

The luminance value curve of the light-emitting element 40 of each pixel PXij over time, which is stored in the LUT 162, can be changed according to characteristics of the light-emitting element 40. That is, a user can adjust the luminance value curve stored in the LUT 162, thereby further improving degradation compensation characteristics of the light-emitting element 40 according to characteristics of a product.

Referring back to FIG. 2, the second operation unit 170 may produce the compensated gray data D'1 through D'm (respectively for the pixels PXij) based on the degradation compensation weight L0/L(ATpx) for each pixel PXij received from the weight calculation unit 160 and provide the compensated gray data D'1 through D'm to the data driver 30. Specifically, the second operation unit 170 may receive the downscaled gray data D1 through Dm (respectively for the pixels PXij) from the downscaling unit 130 and produce the compensated gray data D'1 through D'm (respectively for the pixels PXij) by multiplying the downscaled gray data D1 through Dm by the degradation compensation weights L0/L (ATpx) for the pixels PXij, respectively. That is, the compensated gray data D'1 through D'm (respectively for the pixels PXij) may be obtained by Equation 3 below.

Compensated gray data for each pixel=downscaled gray data for each pixel received from the downscaling unit 130×degradation compensation weight $L0/L(ATpx)$ for each pixel (Equation 3).

The compensated gray data D'1 through D'm (respectively for the pixels PXij) are provided to the data lines via the data driver 30 (see FIG. 1).

Hereinafter, a method of compensating for degradation of the light-emitting apparatus will be described with reference to FIGS. 1 through 3. For ease of description, the present invention will hereinafter be described using certain numerical values. However, the present invention is not limited to the numerical values, and these numerical values can be changed according to the situation.

When intervals are, for example, one minute, the first operation unit 140 may receive the downscaled gray data D1 through Dm that constitute one frame and are respectively for the pixels PXij at 0, 1, 2, 3, 4, etc. minutes, and calculate the degradation time Tpx of each pixel PXij based on the downscaled gray data D1 through Dm. For example, the intervals may double each time as described above. That is, the first operation unit 140 may receive the downscaled gray data D1 through DM at 0, 1, 3, 7, etc. minutes. For ease of description, it is assumed that the intervals are one (1) minute.

For example, if the current time is at 2.5 minutes, the gray data D1 through Dm having the first range (e.g., a range of 0 to 1023), which are stored in the frame memory 120, are downscaled by the downscaling unit 130 to have the second range (e.g., a range of 0 to 720), and the downscaled gray data D1 through Dm (respectively for the pixels PXij) are provided directly to the second operation unit 170. The second operation unit 170 receives the downscaled gray data D1 through Dm (respectively for the pixels PXij) and multiplies the downscaled gray data D1 through Dm by the degradation compensation weights L0/L(ATpx) calculated at 2 minutes for the pixels PXij, respectively. As a result, the second operation unit 170 produces the compensated gray data D'1 through D'm (respectively for the pixels PXij) and provides the compensated gray data D'1 through D'm to the data driver 30.

If the current time is at 3 minutes, the downscaling unit 130 provides the downscaled gray data D1 through Dm having the second range (e.g., a range of 0 to 720) to the first operation unit 140 in response to the read signal READ received from the first operation unit 140. Then, the first operation unit 140 calculates the degradation time Tpx of each pixel PXij at the current time by using the above-described Equation 1. Next, the accumulation operation unit 150 calculates the accumulated degradation time ATpx of each pixel PXij using the calculated degradation time Tpx of each pixel PXij.

For example, if downscaled gray data for any one pixel is 360 and if the reference gray data is 720, since the intervals are one minute, the degradation time Tpx of the pixel at the current time is 360/720×1=0.5. If the degradation times Tpx of the pixel up to a previous time, i.e., at 0, 1, and 2 minutes are 0.5, 0.8 and 0.3, respectively, the accumulated degradation time ATpx calculated by the accumulation operation unit 150 for the pixel is 0.5+0.8+0.3+0.5=2.1.

Based on this accumulated degradation time ATpx of each pixel PXij, the LUT 162 calculates the degradation compensation weight L0/L(ATpx) for each pixel PXij using the above-described Equation 2. In the case of the pixel in the above example, since the accumulated degradation time ATpx of the pixel is 2.1, the degradation compensation weight L0/L(2.1) for the pixel is calculated by dividing the initial luminance value L0 by a luminance value L(2.1) corresponding to t=2.1 on the luminance curve of FIG. 3.

Using Equation 3, the second operation unit 170 multiplies the degradation compensation weights L0/L(ATpx) for the pixels PXij respectively by the downscaled gray data D1 through Dm received from the downscaling unit 130 and outputs the compensated gray data D'1 through D'm (respectively for the pixels PXij). In the case of the pixel in the above example, since the downscaled gray data for the pixel, which has been received from the downscaling unit 130, is 360, the compensated gray data for the pixel may be calculated by multiplying 360 by the degradation compensation weight L0/L(2.1) for the pixel.

In the light-emitting apparatus including the degradation compensation unit 100 according to the current exemplary embodiment, the degradation of each light-emitting element 40 included in the display panel 10 can be efficiently compensated for according to the degree of degradation of the light-emitting element 40. Therefore, the display reliability of the light-emitting apparatus can be improved. In addition, since a user can control compensation characteristics of the light-emitting element 40 by changing only the luminance value curve stored in the LUT 162 according to characteristics of the light-emitting element 40, the degradation problem of the light-emitting element 40 can be easily solved.

Hereinafter, a degradation compensation unit according to another exemplary embodiment of the present invention will be described with reference to FIG. 4.

Figure 4:
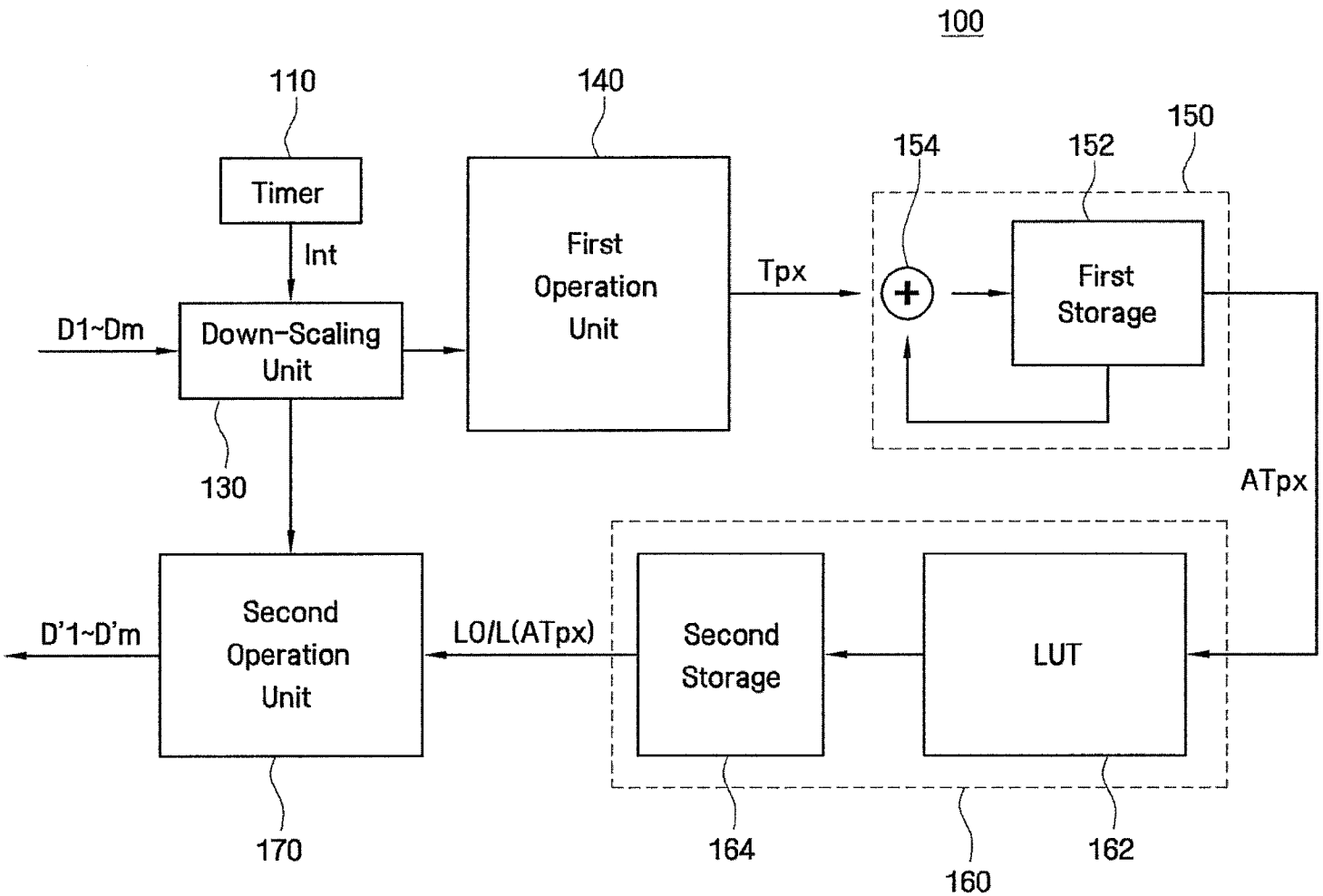
FIG. 4 is a block diagram of a degradation compensation unit according to another exemplary embodiment of the present invention.

FIG. 4 is a block diagram of a degradation compensation unit 100 according to another exemplary embodiment of the present invention.

A description of features and components already described above in relation to the degradation compensation unit 100, the light-emitting apparatus, and the method of compensating for the degradation of the light-emitting apparatus according to the previous exemplary embodiment will be omitted. That is, the following description will focus on the differences between the current and previous exemplary embodiments.

Referring to FIG. 4, a downscaling unit 130 of the degradation compensation unit 100 according to the current exemplary embodiment may receive an interrupt signal Int directly from a timer 110 and provide downscaled gray data for one frame and respectively for a plurality of pixels to a first operation unit 140.

Specifically, the timer 110 may generate the interrupt signal Int at set or predetermined intervals and provide the generated interrupt signal Int directly to the downscaling unit 130. When receiving the interrupt signal Int, the downscaling unit 130 may downscale gray data D1 through Dm having a first range to have a second range and provide the downscaled gray data D1 through Dm to the first operation unit 140, wherein the gray data D1 through Dm are respectively for a plurality of pixels and are received from an external source. When not receiving the interrupt signal Int, the downscaling unit 130 may downscale the gray data D1 through Dm having the first range to have the second range and provide the downscaled gray data D1 through Dm only to a second operation unit 170.

Since other components have been described above, any repetitive detailed description thereof is omitted. Furthermore, the operation and effects of the degradation compensation unit 100 according to the current exemplary embodiment are the same as (or substantially the same as) those of the degradation compensation unit 100 according to the previous exemplary embodiment, and thus a detailed description thereof is omitted.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A degradation compensation unit comprising:

a first operation unit for receiving downscaled gray data of each pixel for one frame at set intervals and for calculating a degradation time of each pixel corresponding to the downscaled gray data;

an accumulation operation unit for receiving the degradation time of each pixel from the first operation unit and for calculating an accumulated degradation time of each pixel by accumulating the degradation time of each pixel;

a weight calculation unit for receiving the accumulated degradation time of each pixel from the accumulation operation unit and for calculating a degradation compensation weight for each pixel based on the accumulated degradation time of each pixel; and a second operation unit for receiving the degradation compensation weight for each pixel, for producing compensated gray data for each pixel corresponding to the degradation compensation weight for each pixel, and for providing the compensated gray data for each pixel to a data driver.

2. The degradation compensation unit of claim 1, further comprising:

a timer for generating an interrupt signal at the set intervals;

a frame memory for storing gray data which have a first range and are for one frame and respectively for a plurality of pixels; and a downscaling unit for downscaling the gray data having the first range to have a second range, wherein the first operation unit is configured to transmit a read signal to the downscaling unit when receiving the interrupt signal from the timer, and when receiving the read signal, and wherein the downscaling unit is configured to downscale the gray data having the first range received from the frame memory to have the second range and to provide the downscaled gray data to the first operation unit.

3. The degradation compensation unit of claim 2, wherein the set intervals gradually increase.

4. The degradation compensation unit of claim 3, wherein the set intervals double each time.

5. The degradation compensation unit of claim 1, further comprising:

a timer for generating an interrupt signal at the set intervals; and a downscaling unit for downscaling gray data, which have a first range and are for one frame and respectively for a plurality of pixels, to have a second range, wherein the downscaling unit is configured to downscale the gray data having the first range to have the second range when receiving the interrupt signal from the timer and to provide the downscaled gray data to the first operation unit.

6. The degradation compensation unit of claim 1, wherein the first operation unit is configured to calculate the degradation time of each pixel utilizing the set intervals, the downscaled gray data for each pixel, and reference gray data.

7. The degradation compensation unit of claim 6, wherein the degradation time of each pixel is calculated by dividing the downscaled gray data for each pixel by the reference gray data and multiplying the division result by the set intervals.

8. The degradation compensation unit of claim 1, wherein the accumulation operation unit comprises:

a first storage for storing the accumulated degradation time of each pixel up to a previous time; and an adder for adding the degradation time of each pixel received from the first operation unit to the accumulated degradation time of each pixel up to the previous time.

9. The degradation compensation unit of claim 1, wherein the weight calculation unit comprises:

a look-up table (LUT) for storing a luminance value curve of a light-emitting element of each pixel over time, for receiving the accumulated degradation time of each pixel, and for outputting the degradation compensation weight for each pixel; and a second storage for storing the degradation compensation weight for each pixel.

10. The degradation compensation unit of claim 9, wherein the degradation compensation weight for each pixel is calculated by dividing an initial luminance value by a luminance value corresponding to the accumulated degradation time of each pixel on the luminance value curve over time which is stored in the LUT.

11. The degradation compensation unit of claim 9, wherein the luminance value curve is selectively adjustable by a user.

12. The degradation compensation unit of claim 1, wherein the compensated gray data for each pixel is produced by multiplying the downscaled gray data for each pixel by the degradation compensation weight for each pixel.

13. A light-emitting apparatus comprising:

a display panel comprising a plurality of pixels defined by a plurality of gate lines and a plurality of data lines, each of the pixels comprising at least one light-emitting element;

a gate driver for transmitting gate signals to the gate lines; and a data driver for receiving compensated gray data respectively for the pixels from a degradation compensation unit and for transmitting the compensated gray data to the data lines, wherein the degradation compensation unit comprises:

a first operation unit for receiving downscaled gray data of each of the pixels for one frame at set intervals and for calculating a degradation time of each of the pixels corresponding to the downscaled gray data;

an accumulation operation unit for receiving the degradation time of each of the pixels from the first operation unit and for calculating an accumulated degradation time of each of the pixels by accumulating the degradation time of each of the pixels;

a weight calculation unit for receiving the accumulated degradation time of each of the pixels from the accumulation operation unit and for calculating a degradation compensation weight for each of the pixels based on the accumulated degradation time of each of the pixels; and a second operation unit for receiving the degradation compensation weight for each of the pixels, for producing compensated gray data for each of the pixels corresponding to the degradation compensation weight for each of the pixels, and for providing the compensated gray data for each of the pixels to the data driver.

14. The light-emitting apparatus of claim 13, wherein the light-emitting element comprises an organic light-emitting element, and the data driver is configured to drive the light-emitting element utilizing a constant-voltage driving method.

* * * * *